US006648598B2

(12) United States Patent
Mimura

(10) Patent No.: US 6,648,598 B2
(45) Date of Patent: Nov. 18, 2003

(54) AXIAL FLOW FAN

(75) Inventor: Masahiro Mimura, Ibaragi (JP)

(73) Assignee: Japan Servo Co., Ltd., Tokyo (JP)

( * ) Notice: Subject to any disclaimer, the term of this patent is extended or adjusted under 35 U.S.C. 154(b) by 22 days.

(21) Appl. No.: 10/075,504

(22) Filed: Feb. 14, 2002

(65) Prior Publication Data

US 2002/0114698 A1 Aug. 22, 2002

(30) Foreign Application Priority Data

Feb. 19, 2001 (JP) ..... 2001-041688

(51) Int. Cl.[7] ..... F04D 29/38

(52) U.S. Cl. ..... 415/220; 416/236 R; 416/237; 416/228

(58) Field of Search ..... 415/220; 416/235, 416/236 R, 237, 228, 191, 192, 243, DIG. 5, 223 R

(56) References Cited

U.S. PATENT DOCUMENTS 5,181,830 A * 1/1993 Chou ..... 416/223 R 6,196,802 B1 * 3/2001 Matsumoto ..... 416/229 R

FOREIGN PATENT DOCUMENTS

JP 06137297 5/1994

* cited by examiner

*Primary Examiner*—Edward K. Look
*Assistant Examiner*—Kimya N McCoy
(74) *Attorney, Agent, or Firm*—Patterson, Thuente, Skaar & Christensen, L.L.C.

(57) ABSTRACT

An axial flow fan wherein an impeller having a plurality of blades is supported rotatably in the cylindrical cavity portion of a venturi case so that an outer peripheral edge of each of the blades faces to an inner peripheral surface of the cavity portion with a small air gap. The outer peripheral edge of the blade is increased in thickness gradually toward a discharge port side of the venturi case from a suction port side of the venturi case. An peripheral edge portion of the blade at a suction port side of the venturi case is bent in the circumferential direction from a negative pressure surface side of the blade, so that the edge is small in thickness. An outer peripheral edge portion of the blade at a discharge port side of the venturi case has a portion extending circumferentially from a positive pressure surface side of the blade.

4 Claims, 3 Drawing Sheets

AXIAL FLOW FAN

BACKGROUND OF THE INVENTION

1. Field of the Invention

The present invention relates to an axial flow fan, and more particularly relates to a noiseless axial flow fan.

2. Description of the Prior Art

Conventionally, an axial flow fan has been proposed as shown in the Japanese Patent Application Laid-Open No. 137297/94, wherein an outer peripheral edge of a blade is processed specially in order to reduce a noise of the fan.

FIG. 4 is a vertically sectioned side view of the conventional axial flow fan for explaining eddy currents of air to be generated at blade edges. FIG. 5 is a sectional front view of the blade shown in FIG. 4. A reference numeral 1 denotes a venturi case of the axial flow fan having a cylindrical cavity portion, 1-1 denotes an inner peripheral surface of the cavity portion of the venturi case 1, 1-11 denotes a suction port of the venturi case 1, 1-13 denotes a discharge port of the venturi case 1, 2 denotes an impeller driven by an electric motor, 2-1 denotes a plurality of blades of the impeller 2, 2-11 denotes an outer peripheral edge portion at the suction port side of the blade 2-1, 2-12 denotes an outer peripheral edge portion at an intermediate portion of the blade 2-1, 2-13 denotes an outer peripheral edge portion at the discharge port side of the blade 2-1, 2-14 denotes a negative pressure surface of the blade 2-1, 2-15 denotes a positive pressure surface of the blade 2-1, 3 denotes an air current, 4 denotes a leakage current of air, and 6 denotes a small air gap formed between the inner peripheral surface 1-1 of the cavity portion and the outer peripheral edge of the blade 2-1.

In the conventional axial flow fan shown in FIG. 4 and FIG. 5, the leakage current of air 4 directed from the positive pressure surface side to the negative pressure surface side is suppressed, so that the eddy currents of air generated at the blade edge in the small air gap is suppressed.

However, it is required to reduce more of the noise. In order to reduce the noise, it is necessary to reduce further the eddy currents of air to be generated in the gap between the inner peripheral surface of the cavity portion and an outer peripheral edge of the blade by reducing the leakage current of air flowing from the positive pressure side to the negative pressure side of the blade.

SUMMARY OF THE INVENTION

An object of the present invention is to provide an axial flow fan which solves the above tasks and problems.

Another object of the present invention is to provide an axial flow fan comprising a venturi case having a cylindrical cavity portion, an impeller having a plurality of blades, supported rotatably in the cylindrical cavity portion so that an outer peripheral edge of each of the blades faces to an inner peripheral surface of the cavity portion with a small air gap, and an electric motor for rotating the impeller, wherein the outer peripheral edge of the blade is increased in thickness gradually toward a discharge port side of the venturi case from a suction port side of the venturi case.

An outer peripheral edge portion of the blade at a suction port side of the venturi case is bent in the circumferential direction from a negative pressure surface side of the blade, so that the edge is small in thickness, and an outer peripheral edge portion of the blade at a discharge port side of the venturi case has a portion extending circumferentially from a positive pressure surface side of the blade so as to increase the thickness of the edge portion.

A circumferential length of an outer peripheral surface of the blade facing the inner peripheral surface of the cavity portion is small at the suction port side so that a leakage current of air flowing into a small air gap formed between the inner peripheral surface of the cavity portion and the outer peripheral edge of the blade is not prevented, but is increased gradually toward the discharge port side of the venturi case so that the leakage current of air flowing into the small air gap is suppressed gradually.

Other object and advantages will become apparent from the following description of the preferred embodiments taken in conjunction with the accompanying drawings.

DESCRIPTION OF THE PREFERRED EMBODIMENTS

Figure 1:
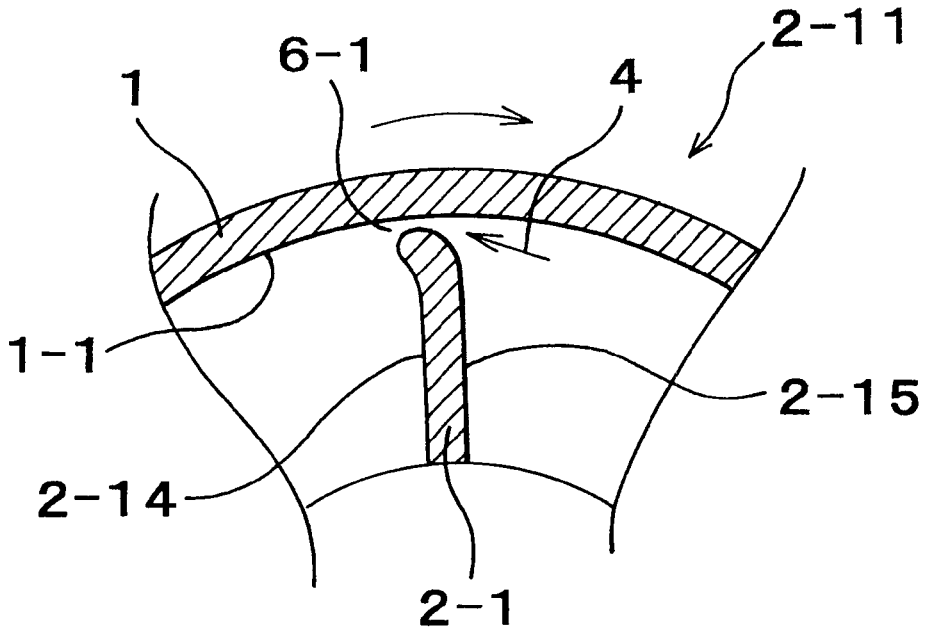
FIG. 1 is a vertically sectioned front view of a suction port side of an axial flow fan in accordance with the present invention.
Figure 2:
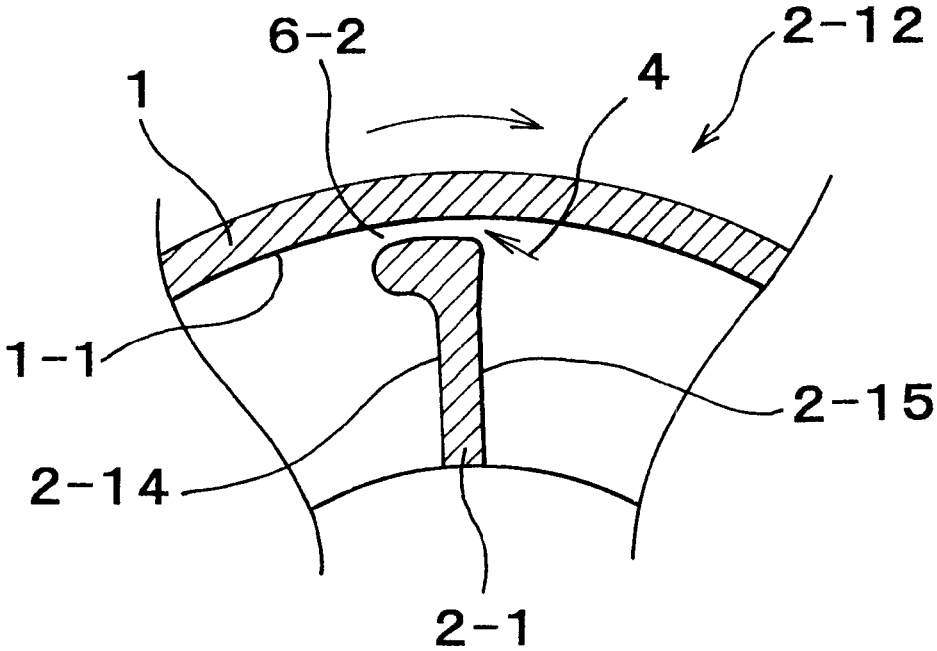
FIG. 2 is a vertically sectioned front view of an intermediate portion of the axial flow fan shown in FIG. 1.
Figure 3:
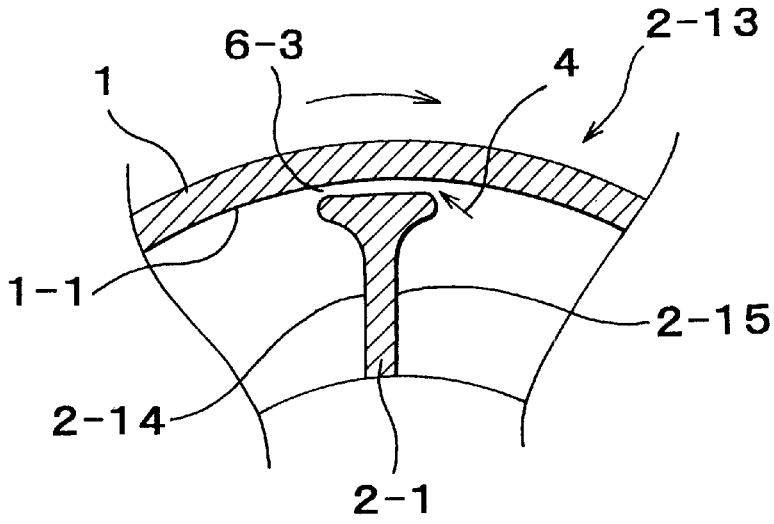
FIG. 3 is a vertically sectioned front view of a discharge port side of the axial flow fan shown in FIG. 1.
Figure 4:
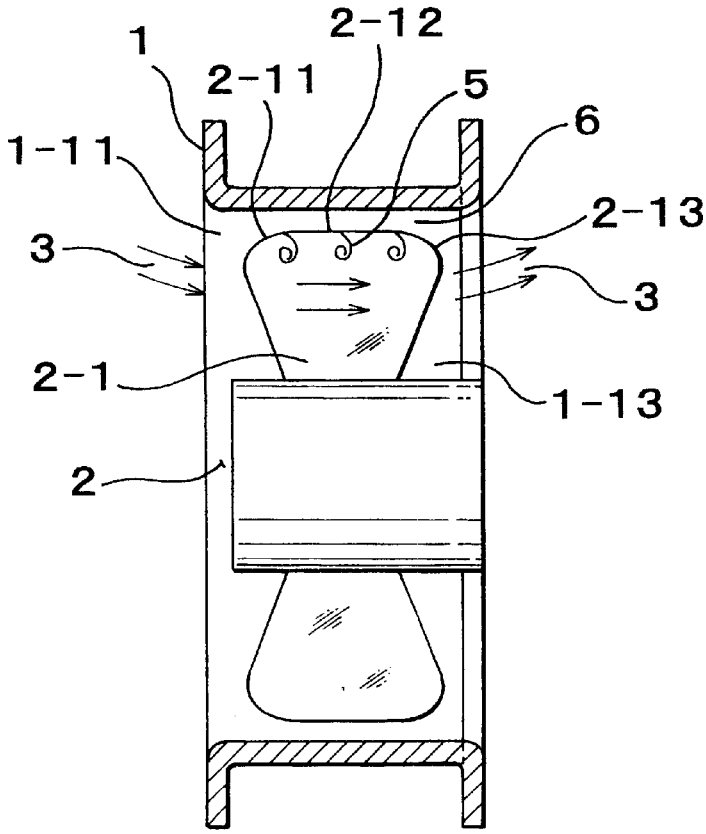
FIG. 4 is a vertically sectioned side view of a conventional axial flow fan for explaining eddy currents of air generated at a blade edge.
Figure 5:
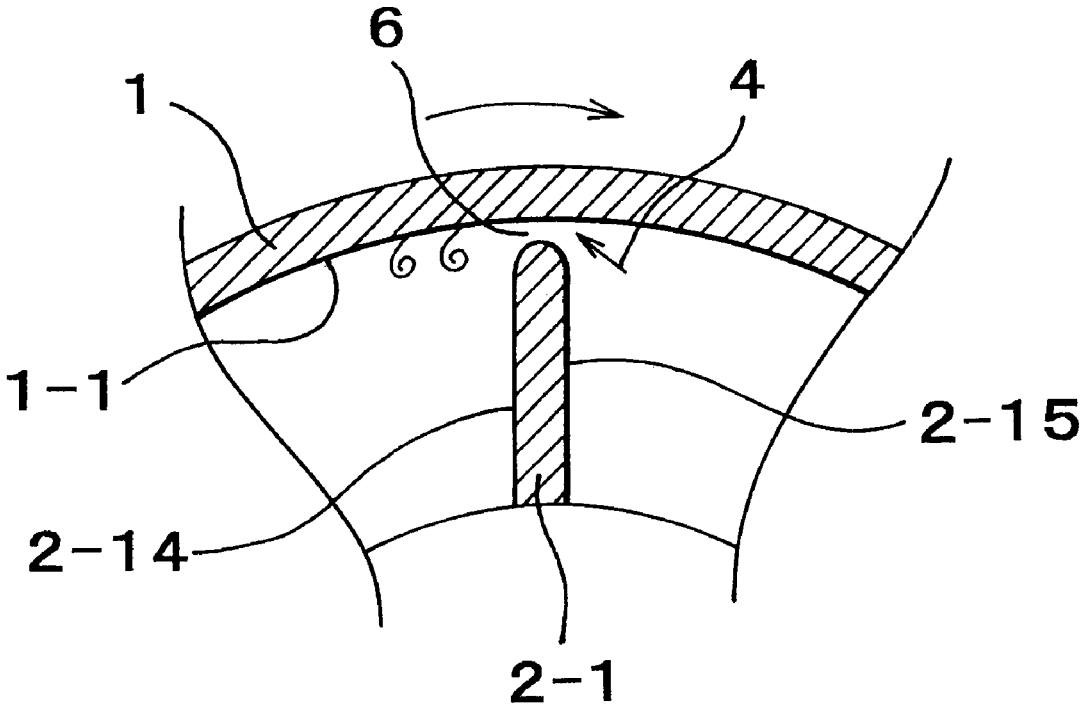
FIG. 5 is a sectional front view of the blade shown in FIG. 4.

FIG. 1 is a vertically sectioned front view of a suction port side of an axial flow fan in accordance with the present invention, FIG. 2 is a vertically sectioned front view of an intermediate portion of the axial flow fan shown in FIG. 1, and FIG. 3 is a vertically sectioned front view of a discharge port side of the axial flow fan shown in FIG. 1.

According to the axial flow fan of the present invention, an outer peripheral edge portion 2-11 of a blade 2-1 at a suction port side of the axial flow fan is bent in the circumferential direction from a negative pressure surface side 2-14 of the blade 2-1, so that the edge of the blade 2-1 is small in thickness as shown in FIG. 1, and that an air can easily be entered from a suction port side 1-11 of a cavity portion of a venturi case 1 into a small air gap 6 formed between an inner peripheral surface 1-1 of a cavity portion of the venturi case 1 and an outer peripheral edge portion of the blade 2-1 at the suction port side 1-11 of the cavity portion.

Further, according to the axial flow fan of the present invention, the edge of the blade 2-1 is increased in thickness gradually toward a discharge port side 1-13 of the venturi case 1 from the suction port side 1-11, so that a circumferential length of an outer peripheral surface of the blade 2-1 facing the inner peripheral surface 1-1 of the cavity portion is increased gradually.

An outer peripheral edge portion 2-12 of the blade 2-1 at an intermediate portion of the venturi case 1 is increased in thickness by a portion extending in the circumferential direction from a negative pressure surface 2-14 of the blade 2-1, as shown in FIG. 2, and an outer peripheral edge 2-13 of the blade 2-1 at the discharge port side 1-13 of the blade 2-1 is more increased in thickness by portions extending circumferential direction from the negative pressure surface 2-14 and a positive pressure surface 2-15, as shown in FIG. 3, so that a circumferential length of the outer peripheral surface of the blade 2-1 facing the inner peripheral surface 1-1 of the cavity portion is more increased.

Accordingly, in the axial flow fan of the present invention, the leakage current of air flowing due to the air pressure into the small air gap 6 formed between the inner peripheral surface 1-1 of the cavity portion and the outer peripheral edge portion 2-11 of the blade 2-1 at the suction port side 1-11 of the venturi case is not prevented, but the leakage current of air flowing due to the air pressure which is increased according to the axial flow of air in the cavity portion into the small air gap 6 formed between the inner peripheral surface 1-1 of the cavity portion and the outer peripheral edge portion 2-12 of the blade 2-1 at the intermediate portion or the outer peripheral edge portion 2-13 of the blade 2-1 at the discharge port side of the venturi case is prevented by increasing the length of the small air gap 6 in the circumferential direction through which the leakage current of air flows and by increasing the flow resistance of the air.

While the invention has been particularly shown and described with reference to the preferred embodiments thereof, it will be understood by those skilled in the art that various changes in form and details may be made therein without departing from the spirit and scope of the invention as defined by the appended claims.

What is claimed is:

1. An axial flow fan comprising a venturi case having a cylindrical cavity portion, an impeller having a plurality of blades, supported rotatably in the cylindrical cavity portion so that an outer peripheral edge of each of the blades faces to an inner peripheral surface of the cavity portion with a small air gap, and an electric motor for rotating the impeller, wherein the outer peripheral edge of the blade is increased in thickness gradually toward a discharge port side of the venturi case from a suction port side of the venturi case, wherein an outer peripheral edge portion of the blade at a suction port side of the venturi case is bent in the circumferential direction from a negative pressure surface side of the blade, so that the edge is small in thickness, and wherein an outer peripheral edge portion of the blade at a discharge port side of the venturi case has a portion extending circumferentially from a positive pressure surface side of the blade.

2. The axial flow fan as claimed in claim 1, wherein a circumferential length of an outer peripheral surface of the blade facing the inner peripheral surface of the cavity portion is small at the suction port side so that a leakage current of air flowing into a small air gap formed between the inner peripheral surface of the cavity portion and the outer peripheral edge of the blade is not prevented, but is increased gradually toward the discharge port side of the venturi case so that the leakage current of air flowing into the small air gap is suppressed gradually.

3. An axial flow fan comprising a venturi case having a cylindrical cavity portion, an impeller having a plurality of blades, supported rotatably in the cylindrical cavity portion so that an outer peripheral edge of each of the blades faces to an inner peripheral surface of the cavity portion with a small air gap, and an electric motor for rotating the impeller, wherein an outer peripheral edge portion of the blade at a suction port side of the venturi case is curved toward a negative pressure side of the blade, wherein an outer peripheral edge portion of the blade at an intermediate portion between the suction port side and a discharge port side of the venturi case has a portion extending to the negative pressure side of the blade, and wherein an outer peripheral edge portion of the blade at the discharge port side of the venturi case has portions extending to the negative pressure side and a positive pressure side of the venturi case, wherein said intermediate portion is not circular.

4. The axial flow fan as claimed in claim 3, wherein a thickness of the outer peripheral edge portion of the blade is small at the suction port side so that a leakage current of air flowing into a small air gap formed between the inner peripheral surface of the cavity portion and the outer peripheral edge of the blade is not prevented, but is increased gradually toward the discharge port side of the venturi case so that the leakage current of air flowing into the small air gap is suppressed gradually.

* * * * *